United States Patent [19]

Ichikawa

[11] Patent Number: 4,904,169

[45] Date of Patent: Feb. 27, 1990

[54] SCROLL TYPE COMPRESSING APPARATUS HAVING STRENGTHENED SCROLL MEMBER

[75] Inventor: Tutomu Ichikawa, Fujinomiya, Japan

[73] Assignee: Kabushiki Kaisha Toshiba, Tokyo, Japan

[21] Appl. No.: 222,272

[22] Filed: Jul. 21, 1988

[30] Foreign Application Priority Data

Aug. 28, 1987 [JP] Japan ..... 62-214324

[51] Int. Cl.[4] ..... F04C 18/04

[52] U.S. Cl. ..... 418/55

[58] Field of Search ..... 418/55 A, 150

[56] References Cited

U.S. PATENT DOCUMENTS 4,547,137 10/1985 Terauchi et al. ..... 418/55 A

FOREIGN PATENT DOCUMENTS 59-23096 2/1984 Japan ..... 418/55 A 59-58187 4/1984 Japan ..... 418/55 A

*Primary Examiner*—John J. Vrablik

*Attorney, Agent, or Firm*—Helfgott & Karas

[57] ABSTRACT

A scroll type compressing apparatus includes stationary and movable scroll wraps each having a strengthened inner end wall surface portion, and minimizes an excessive compression of a gaseous fluid in a compressing cell defined by the scroll wraps. The inner end wall surface portion is formed by an arcuate surface and a straight line surface tangent to an involute generating base circle from a line contacting point of one of the scroll wraps at which the inner end portion of the other scroll wrap contacts the inner wall surface of one of the scroll wraps when the gaseous fluid in the compressing cell is compressed at a prescribed target compression ratio.

4 Claims, 2 Drawing Sheets

SCROLL TYPE COMPRESSING APPARATUS HAVING STRENGTHENED SCROLL MEMBER

BACKGROUND OF THE INVENTION

1. Field of the invention

The present invention relates, in general, to compressing apparatus. More specifically, the invention relates to a scroll type compressing apparatus wherein a variable compressing space is defined between a stationary scroll member and a movable scroll member for compressing a gaseous fluid.

2. Description of the prior art

As is well known, a scroll type compressor typically includes a stationary scroll member and a movable scroll member. Each scroll member has a spiral wrap of involute or the like configuration. The stationary scroll member and the movable scroll member are arranged to oppose one another such that one end of sprial each wrap is in contact with the surface of the opposing scroll member. As the movable scroll member moves, the volume of a crescent shaped compressing shape defined by the pair of spiral wraps is reduced to carry out the compressing operation for a gaseous fluid such as, e.g., refrigerant, sealed in the compressing space.

As shown in FIG. 1, in such a compressor described above, each wrap 11, 13 of a stationary scroll member 15 and a movable scroll member 17 is formed in the involute curve, as described above, and each end portion of wraps 11 and 13 also is formed in the combination of the involute curved wall surface and an arcuate wall surface. The inner surface of each end portion of wraps 11 and 13 is formed on an arc-shape, which has a relatively large diameter extending to the outside of the locus of the involute of the remaining portion of the wrap 11, 13. Therefore, the thickness of each end portion of wraps 11 and 13 decreases, and the stress against each end portion increases when operating, resulting in decrease in strength of wraps 11 and 13. Cracks may occur during an extended use.

To avoid such undesirable cracks described above, an improved scroll type fluid compressor described in U.S. Pat. No. 4,547,137 issued to Terauchi et al. has thickened spiral elements. In this prior art, the inner edge portion of each spiral element or the inner middle portion of each spiral element exposed to the inner-most fluid pocket is thickened toward the inner-most fluid pocket. This prior art scroll compressor may avoid cracks, and may also minimize re-expansion of the compressed fluid. However, it may cause an excessive compression of the fluid due to the minimized fluid pocket, resulting in an increase in the power consumption.

SUMMARY OF THE INVENTION

Accordingly, it is an object of the present invention to strengthen scroll members of a scroll type compressor without causing undesirable compression of a gaseous fluid.

To accomplish the above-object, a scroll type compressing apparatus includes a driving section and a compressing section for compressing gaseous fluid. The compressing section includes a stationary scroll member having a first spiral wrap defined in part by inner and outer involute side wall surfaces, and a movable scroll member having a second spiral wrap defined in part by inner and outer involute side wall surfaces engaging with the first spiral wrap in order to establish at least one variable volume compressing cell between the first and second spiral wraps by orbital movement. The first and second spiral wrap has an inner end wall surface portion which is defined by an arcuate wall surface and a straight line wall surface. The straight line wall surface is tangent to an involute generating base circle of one of the spiral wraps from a first line contacting point at which the end portion of one of the spiral wraps contacts the inner involute side wall surface of the other spiral wrap when the gaseous fluid in the compressing cell is compressed at a prescribed target compression ratio. The arcuate wall surface has a prescribed radius and is disposed between an arc having a predetermined orbital movement radius and the involute curve derived from the involute generating base circle of one of the spiral wraps. One of the ends of the arcuate wall surface is connected to one of the ends of the straight line wall surface. The other end of the arcuate wall surface is connected to the inner involute wall surface of one of the spiral wraps at a second line contacting point at which the end portion of the other spiral wrap contacts the inner involute side wall surface of one of the spiral wraps when the gaseous fluid in the compressing cell is compressed at the prescribed target compression ratio, thereby minimizing excessive compression of the gaseous fluid in the variable volume compression cell by the stationary and movable scroll members.

BRIEF DESCRIPTION OF THE DRAWINGS

These and other objects and advantages of this invention will become apparent from the following detailed description of the presently preferred embodiment of the invention, taken in conjunction with the accompanying drawings of which.

DETAILED DESCRIPTION OF THE PREFERRED EMBODIMENT

The preferred embodiment of the present invention will now be described in more detail with reference to the accompanying drawings.

Figure 2:
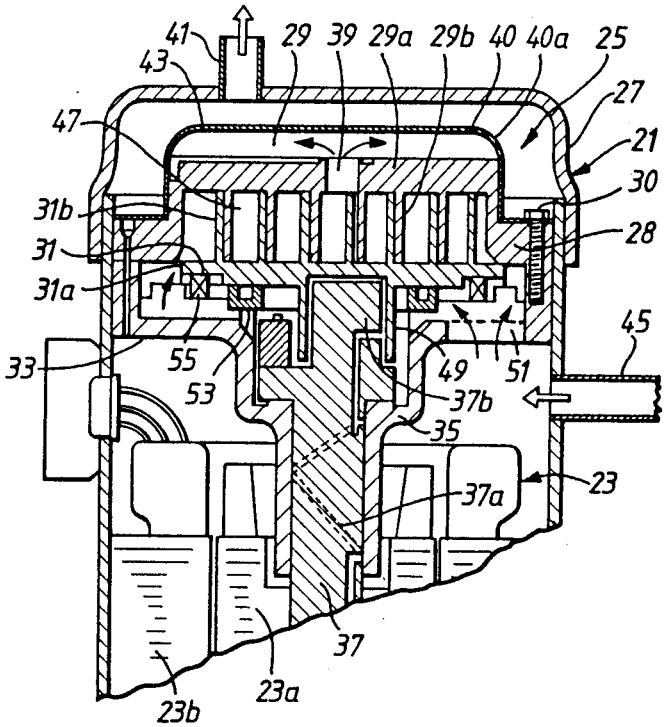
FIG. 2 is a cross sectional side view illustrating a portion of a scroll type compressing apparatus of one embodiment of the present invention.

As shown FIG. 2, compressor 21 includes a driving unit 23 and a compressing unit 25 arranged in a sealed case 27. Compressing unit 25 including a stationary scroll member 29 and movable scroll member 31 is mounted on one surface of a frame 33, which is firmly supported by an inner wall of case 27. A main bearing portion 35 is integrally formed at the center of frame 33, and projects from the other surface of frame 33.

Driving unit 23 also is mounted on the other surface of frame 33. A main shaft portion **37*a* of a crank shaft 37 penetrating through driving unit 23 is rotatably supported by main bearing portion 35 of frame 33. Driving unit 23 includes a rotor 23*a* firmly fixed to main shaft portion 37*a* of crank shaft 37, and a stator 23*b* which is fixed to sealed case 27 that it is disposed close to the outer surface of rotor 23*a*. An eccentric shaft portion 37*b* is integrally formed at the top of crank shaft 37. The center of eccentric shaft portion 37*b* is offset at a predetermined distance from the center of main shaft portion 37***a*.

The center portion of stationary scroll member 29 is raised so as to form a disc-plate portion 29*a*. A stationary spiral wrap 29*b* of involute or the like configuration projects from the inner surface of disc-plate portion 29*a* toward the movable member 31. A discharge port 39 is formed in the vicinity of the center of stationary spiral wrap 29*b*. A discharge muffler 40 is fixed on disc-plate portion 29*a* of stationary scroll member 29, and therefore, a space 40*a* is defined between muffler 40 and the upper surface of disc-plate portion 29*a*. A discharge pipe 41 penetrates into sealed case 27, and is fluidly connected to space 40*a* of muffler 40 through a discharge opening 43 formed in the upper surface of muffler 40.

An intake pipe 45 is fixed to the side surface of sealed case 27, and is fluidly connected to the inside of sealed case 27 wherein the driving unit 23 is disposed.

Movable scroll member 31 includes a disc-plate 31*a*, outer surface of which is overlapped with a bottom edge 28 of stationary scroll member 29 and is fixed to bottom edge 28 by a screw 30. A compressing compartment 47 is established between disc-plate portion 29*a* of stationary scroll member 29 and disc-plate 31*a* of movable scroll member 31. A movable spiral wrap 31*b* of involute or the like configuration also projects from a surface of movable scroll member 31 toward compressing compartment 47, and slidably contacts with the inner surface of disc-plate portion 29*a* of stationary scroll member 29. Similarly, stationary spiral wrap 29*b* is held in contact with the surface of disc-plate 31*a* of movable scroll member 31. The surfaces of disc-plate portion 29*a* and disc-plate 31*a* opposite to one another are polished to a planomirror-finish. As a consequence, the walls of stationary spiral wrap 29*b* and movable spiral wrap 31*b* are held in continuous contact with one another, and a plurality of compressing spaces of crescent shape are established by the positional relationship between two spiral wraps 29*b* and 31*b*, as mentioned above.

A bearing portion 49 is formed on the other surface of disc-plate 31*a* of movable scroll member 31, and received eccentric shaft portion 37*b* of crank shaft 37. An intake passage 51 is formed in frame 33, and therefore, a gaseous fluid from intake pipe 45 flows from driving unit 23 to compressing unit through intake passage 51. A thrust ring 53 is disposed on the upper surface of frame 33 to support the thrust load of movable scroll member 31.

For preventing the free rotation of movable scroll member 31 around its own axis (eccentric shaft 37*b*), a ring 55, referred to as an Oldham ring, is disposed between disc-plate 31*a* of movable scroll member 31 and frame 33.

Figure 1:
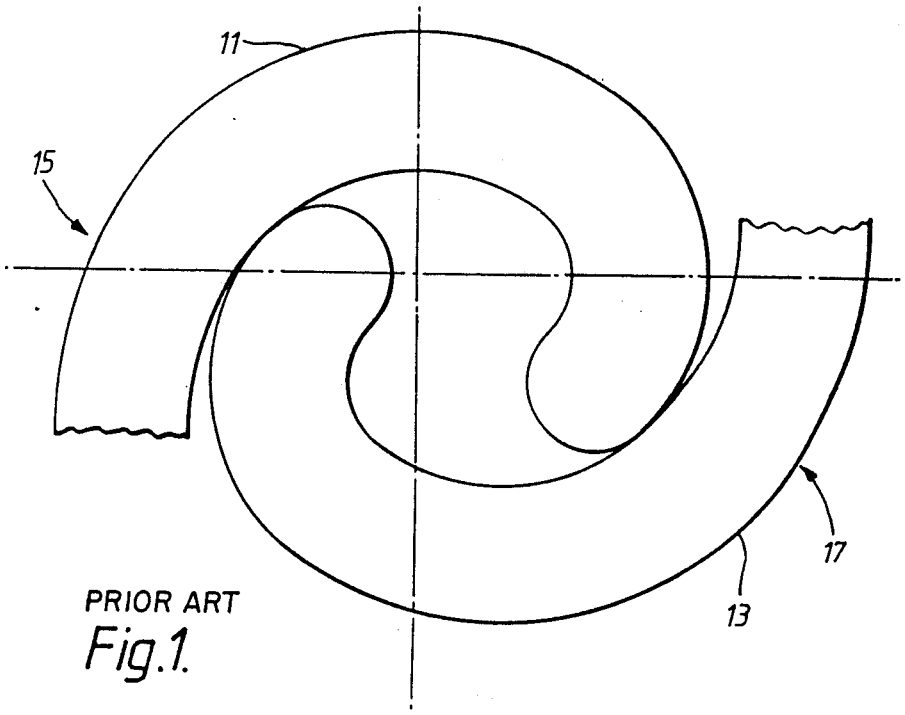
PRIOR ART Fig.1.
FIG. 1 is an enlarged view illustrating the configuration of the inner end portion of the scroll element of a conventional scroll type compressing apparatus.
Figure 3:
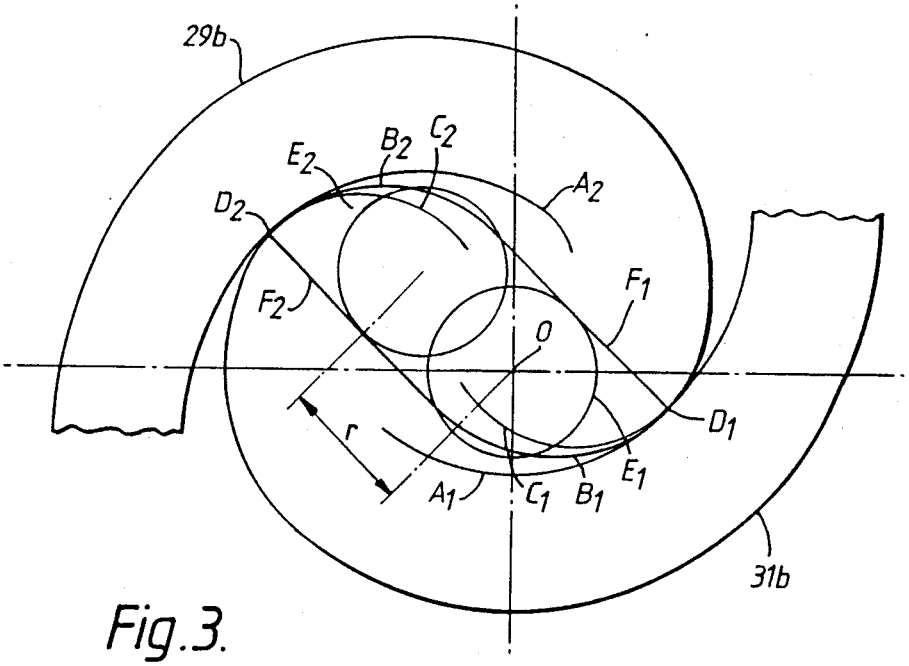
FIG. 3 is an enlarged view illustrating the configuration of the inner end portion of the scroll element of the scroll type compressing apparatus shown in FIG. 2.

Referring to FIG. 3, configurations of the spiral wraps of one embodiment, in particular, the configuration of the inner end portion of each spiral wrap will now be described in more detail. However, the configurations of spiral wraps are essentially similar to one the other, and therefore, the configuration of one of the spiral wraps will be described below.

In FIG. 3, "$D_1$" is a first line contacting point between the outer end surface of stationary spiral wrap 29*b* and the inner surface of movable spiral wrap 31*b* when a gaseous fluid between spiral wraps 29*b* and 31*b* is compressed to a prescribed target compression ratio. "$D_2$" is a second line contacting point between the outer end surface of movable spiral wrap 31*b* and the inner surface of stationary spiral wrap 29*b* when the outer end surface of stationary spiral wraps 29*b* contacts the inner surface of movable spiral wrap 31*b* at line contacting pont $D_1$. When movable scroll member 31 eccentrically moves against stationary scroll member 29 and the end portion of movable spiral wrap 31*b* passes by contacting point $D_2$, the end portion of movable spiral wrap 31*b* gradually separates from the inner surface of stationary spiral wrap 29*b*. Therefore, further compression to the gaseous fluid is not carried out.

The outer and inner surfaces of each spiral wrap are generally formed by involute curve. A circle $E_1$ is an involute generating base circle. The involute curve which is derived from circle $E_1$ outwardly extends from first line contacting point $D_1$, and forms the outer surface of stationary spiral wrap 29*b*. The involute curve $A_2$ which also is derived from circle $E_1$ outwardly extends from second line contacting point $D_2$, and forms the inner surface of stationary spiral wrap 29*b*. A circle $E_2$ also is an involute generating base circle. The involute curve which is derived from circle $E_2$ outwardly extends from second line contacting point $D_2$, and forms the outer surface of movable spiral wrap 31*b*. The involute curve $A_1$ which is derived from circle $E_2$ outwardly extends from first line contacting point $D_1$, and forms the inner surface of movable spiral wrap 31*b*. A distance r between the center of circle $E_1$ and the center of circle $E_2$ is the eccentric amount of movable scroll member 31.

A straight line $F_1$ (straight line wall surface) is a tangent line to the involute generating base circle $E_1$ from first line contacting point $D_1$. The center of an arc $C_1$ is located on tangent line $F_1$, and the radius of arc $C_1$ is the same as the orbital movement radius of movable scroll member 31. An arc $B_1$ extending from first line contacting point $D_1$ has a prescribed radius greater than that of arc $C_1$. The extended end of arc $B_1$ is connected to tangent line $F_2$. Arc $B_1$ is located between arc $C_1$ and involute curve $A_1$ extending from first line contacting point $D_1$ toward involute generating base circle $E_2$.

As has been stated above, the configuration of the inner surface of movable spiral wrap 31*b* from first line contacting point $D_1$ to the inner end portion of wrap 31*b* is defined by tangent line $F_2$ (straight line wall surface) and arc $B_1$ (arcuate wall surface).

In the same manner as movable spiral wrap 31*b* described above, the configuration of the inner surface of stationary spiral wrap 29*b* from second line contacting point $D_2$ to the inner end portion of wrap 29*b* also is defined by tangent line $F_1$ and arc $B_2$.

With the above-described embodiment, since each arc $B_1$, $B_2$ which forms a portion of the inner surface of individual spiral wraps 29*b*, 31*b* is located inside the involute curve, the thickness of the inner end portion of each spiral wrap 29*b*, 31*b* increases, resulting in a strengthened inner end portion of each spiral wrap 29*b*, 31*b*. In particular, the configuration of the inner end surface of each spiral wrap 29*b*, 31*b* is determined by line $F_1$ ($F_2$) tangent to involute generating base circle $E_1$ ($E_2$) from line contacting point $D_1$ ($D_2$), and arc $B_2$ ($B_1$) interconnecting tangent line $F_1$ ($F_2$) and line contacting point $D_2$ ($D_1$), the excessive compression of the gaseous fluid decreases. Therefore, power consumption of the scroll type compressor may be controlled within a desirable range.

The present invention has been described with respect to specific embodiment. However, other embodiments based on the principles of the present invention should be obvious to those of ordinary skill in the art. Such embodiments are intended to be covered by the claims.

What is claimed is:

1. A scroll type compressing apparatus comprising:

a driving section; and a compressing section associated with the driving section for compressing gaseous fluid, the compressing section including:

a stationary scroll member including a first spiral wrap having a prescribed length defined in part by inner and outer involute side wall surfaces, and a movable scroll member including a second spiral wrap having a prescribed length defined in part by inner and outer involute side wall surfaces engaging with the first spiral wrap of the stationary scroll member in order to establish at least one variable volume compressing cell between the first and second spiral wraps by orbital movement, each spiral wrap having an inner wall surface end portion which is defined by an arcuate wall surface and a straight line wall surface, the straight line wall surface of one spiral wrap being tangent to an involute generation circle of the other spiral wrap from a first line contacting point at which the end portion of said one spiral wrap contacts the inner involute side wall surface of the other spiral wrap when the gaseous fluid in the compressing cell defined between said first and second spiral wraps is compressed at a prescribed target compression ratio, the arcuate wall surface having a prescribed radius and being disposed between an arc having a predetermined orbital movement radius and an involute curve derived from the involute generating circle of said one spiral wrap, said arcuate wall surface being connected at one end thereof to the straight line wall surface and at another end thereof to the inner involute side wall surface of one of said spiral wraps at a second line contacting point at which the end portion of the other spiral wrap contacts the inner involute side wall surface of said one spiral wrap when the gaseous fluid in the compressing cell is compressed at the prescribed target compression ratio.

2. An apparatus according to claim 1, wherein the driving section includes a motor having an eccentric rotating shaft.

3. An apparatus according to claim 2, wherein the movable scroll member includes an orbital moving plate, one surface of which is rotatably connected to the eccentric rotating shaft of the motor for causing the orbital movement of the movable scroll member, the second spiral wrap substantially perpendicularly extending from the other surface of the orbital moving plate.

4. An apparatus according to claim 3, wherein the stationary scroll member includes a stationary plate, said first spiral wrap substantially perpendicularly extending from one surface of the stationary plate to form an extended edge, said extended edge of the first spiral wrap being in contact with a surface of the orbital moving plate.

* * * * *